US011644796B2

(12) United States Patent
Hurni

(10) Patent No.: US 11,644,796 B2
(45) Date of Patent: May 9, 2023

(54) TIMEPIECE DIAL PROVIDED WITH A THREE-DIMENSIONAL DECORATION

(71) Applicant: Montres Jaquet Droz SA, La Chaux-de-Fonds (CH)

(72) Inventor: David Hurni, La Chaux-de-Fonds (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 651 days.

(21) Appl. No.: 16/819,369

(22) Filed: Mar. 16, 2020

(65) Prior Publication Data

US 2020/0301368 A1 Sep. 24, 2020

(30) Foreign Application Priority Data

Mar. 18, 2019 (EP) ..... 19163395

(51) Int. Cl.
*G04B 47/04* (2006.01)
*G04B 19/06* (2006.01)

(52) U.S. Cl.
CPC ..... *G04B 47/044* (2013.01); *G04B 19/065* (2013.01)

(58) Field of Classification Search
CPC ..... G04B 19/065; G04B 19/10–106; G04B 45/0076; G04B 47/04–048
See application file for complete search history.

(56) References Cited

U.S. PATENT DOCUMENTS 1,091,009 A * 3/1914 Nelson ..... G04B 19/14 968/157
1,319,044 A * 10/1919 Cohan ..... G04B 19/14 968/157
1,903,003 A * 3/1933 Arthurl ..... G04B 19/14 968/157

(Continued)

FOREIGN PATENT DOCUMENTS

CN 102265226 A 11/2011
CN 102890444 A 1/2013

(Continued)

OTHER PUBLICATIONS

Combined Chinese Office Action and Search Report dated Apr. 15, 2021 in Patent Application No. 202010182367.5 (with English translation of Category of Cited Documents), 6 pages.

(Continued)

*Primary Examiner* — Daniel P Wicklund
(74) *Attorney, Agent, or Firm* — Oblon, McClelland, Maier & Neustadt, L.L.P.

(57) ABSTRACT

A dial for a timepiece, such as a watch, includes at least one three-dimensional decoration offset away from a base plate which forms part of the dial. The decoration is mounted on the base plate by an assembly of elements including a fixing screw, a support bar including a proximal end secured to the base plate by the fixing screw and a distal end attached to a first point of the lower surface of the decoration, a support foot including a proximal end held in a fixed position in the plate of the base plate and a distal end attached to a second (Continued)

point of the lower surface of the decoration, and a spacer which forms a lateral connection between the fixing screw and the support foot, the spacer being secured with the support bar to the base plate by the fixing screw.

15 Claims, 3 Drawing Sheets

(56) References Cited

U.S. PATENT DOCUMENTS

| | | | | |
|---|---|---|---|---|
| 2,196,998 | A * | 4/1940 | Lodge | G04B 19/10 968/153 |
| 3,488,943 | A * | 1/1970 | Giger | G04B 19/14 968/654 |
| 6,229,768 | B1 * | 5/2001 | Nakazawa | G04B 19/065 368/233 |
| 8,976,630 | B2 * | 3/2015 | Oshio | G04B 19/12 368/80 |
| 2011/0019507 | A1 * | 1/2011 | Muraji | G04B 45/0007 368/220 |
| 2013/0028057 | A1 * | 1/2013 | Nagatake | G04B 47/044 368/228 |
| 2014/0313868 | A1 * | 10/2014 | Takematsu | G04B 45/0038 368/232 |
| 2018/0173162 | A1 * | 6/2018 | Hurni | G04B 19/065 |
| 2018/0267477 | A1 * | 9/2018 | Monferrer | G04B 47/044 |
| 2020/0301368 | A1 * | 9/2020 | Hurni | G04B 47/044 |
| 2022/0163926 | A1 * | 5/2022 | Chouet | G04B 19/10 |

FOREIGN PATENT DOCUMENTS

| | | | |
|---|---|---|---|
| CN | 104685425 | A | 6/2015 |
| CN | 204759038 | U | 11/2015 |
| CN | 108205251 | A | 6/2018 |
| EP | 3 339 979 | A1 | 6/2018 |

OTHER PUBLICATIONS

European Search Report dated Oct. 21, 2019 in European Application 19163395.7 filed Mar. 18, 2019 (with English Translation of Categories of Cited Documents), 3 pages.

* cited by examiner

B-B

A-A

TIMEPIECE DIAL PROVIDED WITH A THREE-DIMENSIONAL DECORATION

CROSS-REFERENCE TO RELATED APPLICATION

This application claims priority to European Patent Application No. 19163395.7 filed on Mar. 18, 2019, the entire disclosure of which is hereby incorporated herein by reference.

FIELD OF THE INVENTION

The present invention relates to the field of external components for horology, more particularly to timepieces comprising a dial that bears a three-dimensional decoration.

STATE OF THE ART

To enhance the conventional display components, some timepieces comprise, between the base plate of the dial and the crystal, a decoration giving a particular character to the timepiece. The decoration includes, depending on the case, an automated figure, a motif in relief or a combination of the two. The decorations can be made with precious, fragile materials, such as glass or mother-of-pearl, or with heavier materials such as metal.

EP Patent Application No. 3339979A discloses a dial provided with a three-dimensional decoration, offset away from the dial base plate and secured to the base plate via at least one foot. The decoration is mounted on said foot by means of a pipe arranged to be pressed onto an upper step portion of the foot and resting on a shoulder of said foot. This type of attachment is stable but for decorative pieces of significant dimensions and weight, a plurality of feet is necessary, which increases the complexity of the dial.

SUMMARY OF THE INVENTION

It is an object of the present invention to provide a dial provided with a three-dimensional decoration secured to the dial by a means of attachment which increases the mechanical stability and the resistance of the decoration to shocks and vibrations, compared to existing solutions.

This object is achieved by a dial and by a timepiece according to the annexed claims.

Other features and advantages of the present invention will appear in the following description of preferred embodiments, given by way of non-limiting example, with reference to the annexed drawings.

DETAILED DESCRIPTION OF EMBODIMENTS OF THE INVENTION

Figure 1:
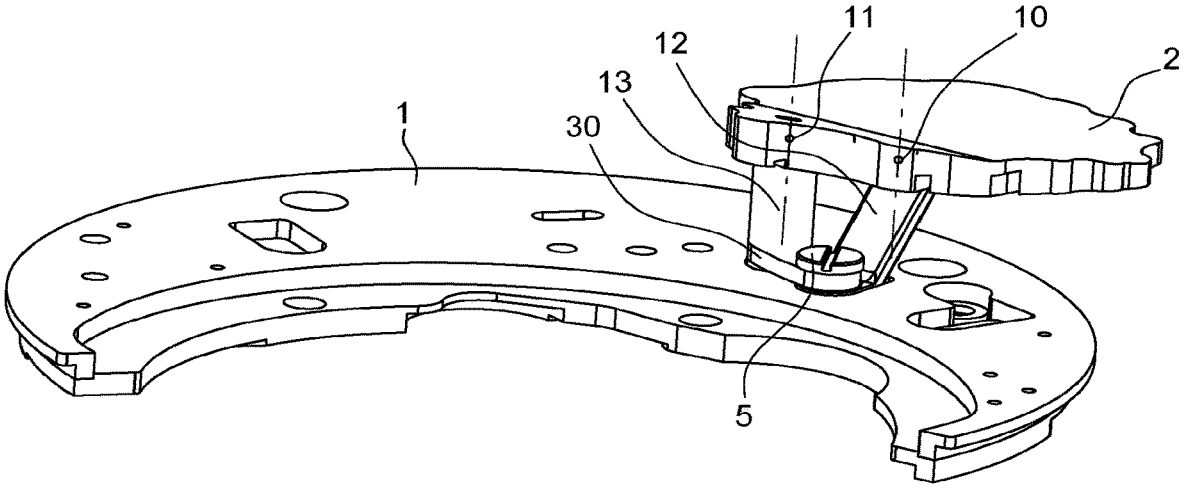
FIG. 1 represents a perspective view of a dial base plate, provided with a three-dimensional decoration according to the invention.
Figure 2A:
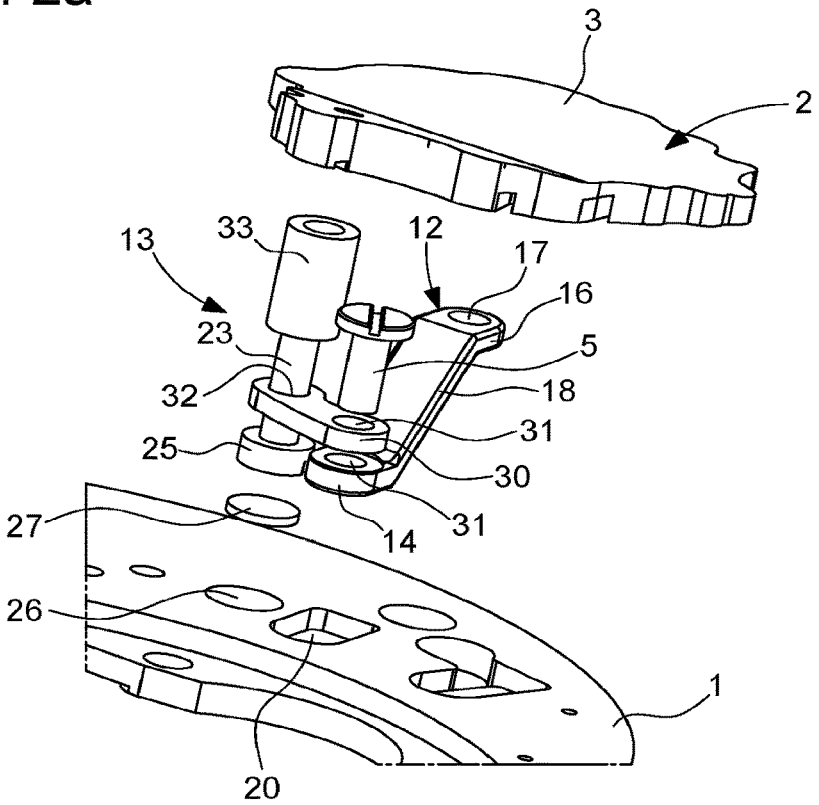
FIGS. 2*a* and 2*b* represent two exploded views of the set of elements which allow the decoration to be secured to the base plate represented in FIG. 1.
Figure 2B:
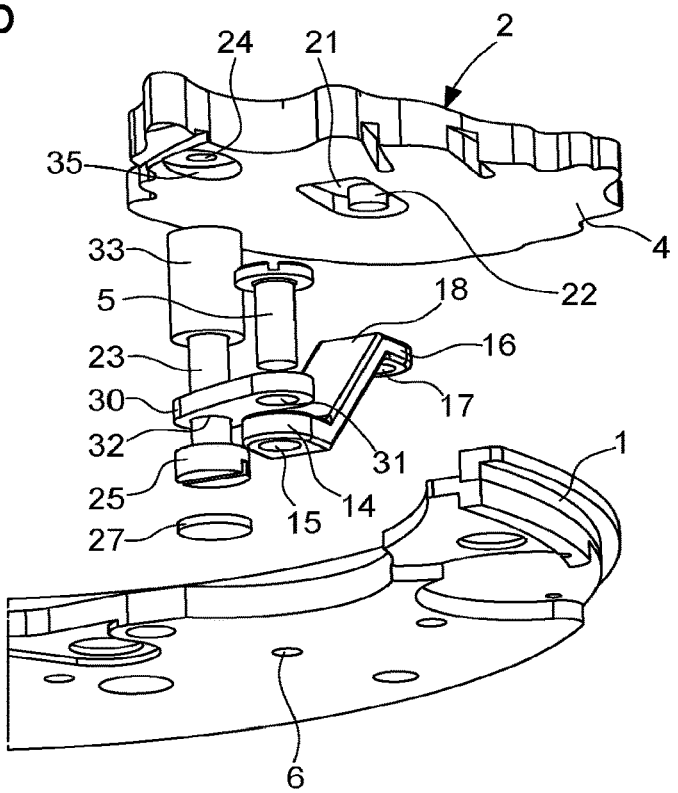

FIG. 1 and the exploded views of FIGS. 2*a* and 2*b* represent a base plate 1 of a watch dial according to one embodiment. This is a plate that forms only one part of the dial, the latter being made by assembling plate 1 to one or more additional plates. According to other embodiments, the dial comprises only one base plate. A three-dimensional decoration 2 is secured to the base plate and offset away from and above the plate. Decoration 2 may be a decorative element made from a rigid material such as a metal, mother-of-pearl or any other material. Decoration 2 comprises an upper surface 3 intended to be arranged facing the watch crystal and a lower surface 4 intended to be arranged on the dial side.

According to the invention, decoration 2 is held in a fixed position with respect to base plate 1, by means of an assembly of elements which has only one point of attachment to base plate 1, achieved by a fixing screw 5, screwed into a threaded hole 6 made in base plate 1. The other elements of the assembly are visible in FIGS. 2*a* and 2*b*. It is seen that decoration 2 is supported at two separate support points 10 and 11, respectively by a support bar 12 and by a support foot 13 (FIG. 1). Support points 10 and 11 are defined as points located on vertical lines which pass through the centre of the means of attachment of foot 13 and of bar 12 to decoration 2; examples of these means will be described in detail below.

Support bar 12 is a part that comprises at least one inclined or curved central portion, such that the projection of support point 10 in the plane of base plate 1 is away from fixing screw 5. According to the embodiment represented in the Figures, support bar 12 is a rigid part which takes the form of an inclined arm 18 comprising, at the proximal end thereof, a first plate 14 provided with a through hole 15 and, at the distal end thereof, a second plate 16 also provided with a through hole 17. First plate 14 is inserted, or in other words, embedded in a cavity 20 of base plate 1, at the bottom of which lies threaded hole 6. Fixing screw 5 passes through hole 15 in first plate 14. Second plate 16 is preferably parallel to first plate 14. Second plate 16 is inserted, or in other words, embedded in a cavity 21 made in lower surface 4 of decoration 2. Said cavity 21 is provided with a central arbor 22 which passes through hole 17 in second plate 16. Second plate 16 is secured to decoration 2 by adhesive bonding or welding. The inclination of arm 18 is such that support bar 12 maintains a fixed distance between base plate 1 and lower surface 4 of decoration 2.

Generally, support foot 13 has a proximal end held in a fixed position in the plane of base plate 1 and a distal end attached to lower surface 4 of decoration 2, at second support point 11, the projection of second point 11 in the plane of base plate 1 being away from fixing screw 5 and from the projection of first point 10. Preferably, the two projections of points 10 and 11 and the centre of fixing screw 5 form a triangle. In the embodiment represented in the Figures, foot 13 includes an arbor 23 which takes the form of a supplementary screw 23 screwed at its distal end into a threaded hole 24 provided in lower surface 4 of decoration 2, said hole 24 preferably not opening onto upper surface 3 of the decoration. Supplementary screw 23 has at its proximal end a screw head 25 which is embedded in a cavity 26 provided in base plate 1, which immobilises the arbor in the plane of base plate 1, with a silicone washer 27 positioned between the bottom of cavity 26 and screw head 25.

Supplementary screw 23 and fixing screw 5 are connected laterally to each other by a spacer 30, mounted above first plate 14 of support bar 12. Spacer 30 has a first through hole 31 for the insertion of fixing screw 5 through the top of spacer 30, and a second through hole 32 next to first hole 31, second hole 32 allowing the insertion of supplementary screw 23 through the bottom of spacer 30. When fixing screw 5 is tightened, it secures support bar 12 and spacer 30 to dial base plate 1. At the same time, spacer 30 keeps head 25 of supplementary screw 23 inside cavity 26, while forming a lateral connection between fixing screw 5 and support foot 13 (in this case supplementary screw 23). A rigid tube 33 surrounds one portion of supplementary screw 23, tube 33 being pressed between lower surface 4 of decoration 2 and spacer 30 when supplementary screw 23 is tightened. A cavity 35 is provided in lower surface 4 of the decoration for receiving the end of tube 33. Threaded hole 24, which receives the end of supplementary screw 23, is at the bottom of cavity 35.

Figure 3A:
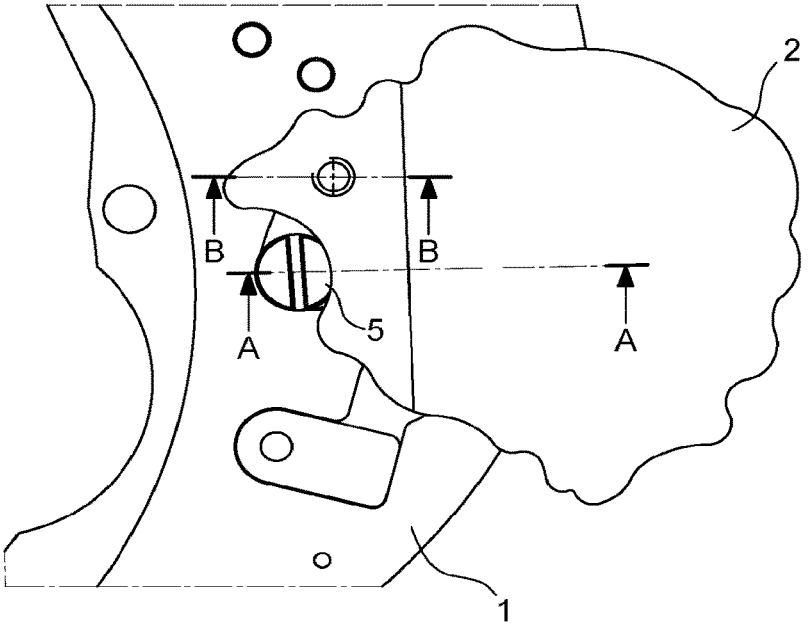
FIG. 3*a* is a plan view of the decoration secured to the base plate.
Figure 3B:
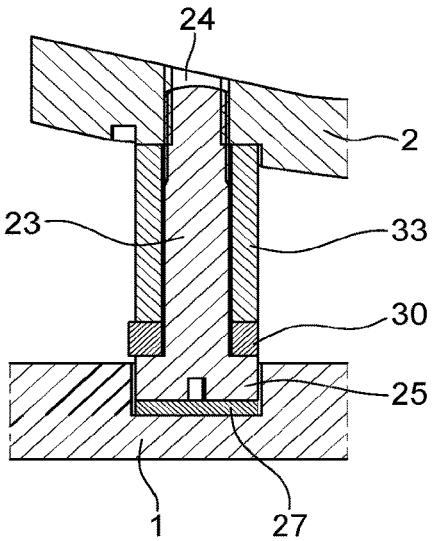
FIGS. 3*b* and 3*c* are sectional views along sections A-A and B-B shown in FIG. 3*a*.
Figure 3C:
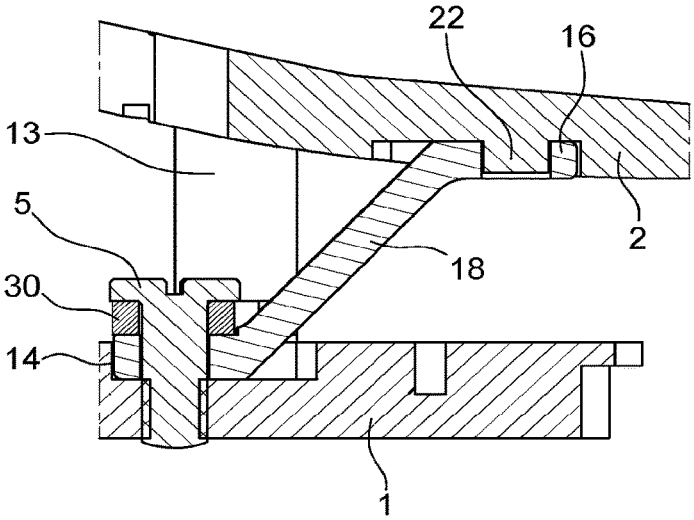

FIGS. 3*a*-3*c* represent the elements described above in sectional views. In the embodiment represented in the Figures, fixing screw 5 is not covered by decoration 2. This makes fixing screw 5 easily accessible for tightening the screw. Embodiments in which fixing screw 5 is partially or entirely covered by decoration 2 are not, however, excluded from the scope of the invention. In such cases, lateral access is required to the head of screw 5 by a wrench or key of small dimensions in order to tighten fixing screw 5.

Decoration 2 is secured to base plate 1 by the following steps which start with the assembly of the various elements. Supplementary screw 23 is inserted into hole 32 in spacer 30 and into tube 33. Support bar 12 is attached to lower surface 4 of decoration 2 at point 11 and supplementary screw 23 is screwed into said lower surface 4 at point 10. Tube 33 ensures that when supplementary screw 23 is tightened, decoration 2 is held at a fixed distance from spacer 30. Then, decoration 2, provided with the assembly of elements, is mounted on base plate 1 by placing screw head 25 inside cavity 26 which contains silicone washer 27 at the bottom of said cavity 26. The silicone washer has a shock and vibration absorber function and offsets differences in tolerances in the superposed elements while providing support on the dial. Finally, fixing screw 5 is inserted into holes 31 and 15 and tightened by being screwed into threaded hole 6 in base plate 1.

This assembly makes it possible, via spacer 30, to distribute shocks and/or vibrations between fixing screw 5, support bar 12 and support foot 13, with vibrations and shocks absorbed by silicone washer 27. This system also makes it possible to distribute the weight of decoration 2 over these same elements. Consequently, in both cases, the load on fixing screw 5 is diminished and this makes the attachment of a heavy decoration 2 more reliable.

Several technical details described for the embodiment represented in the Figures are not limiting for the scope of the invention. For example, foot 13 may have a different shape and be attached to decoration 2 and/or to base plate 1 in an alternative manner, for example by welding or adhesive bonding. It may be an arbor bonded or welded to lower surface 4 of decoration 2 and provided with a portion of increased cross-section which fulfils the same function as screw head 25 of supplementary screw 23. Tube 33 can be omitted in the latter case. Silicone washer 27 can be made from another material having shock absorber properties. Washer 27 may not be required for some weights and/or materials of the decoration. The fixing of support bar 12 to lower surface 4 of the decoration can be achieved by means other than plate 16. Plate 14 may also be replaced by an equivalent element which allows support bar 12 and spacer 30 to be secured by screwing to base plate 1

The invention claimed is:

1. A dial for a timepiece, the dial comprising:

a base plate provided with at least one three-dimensional decoration offset away from the base plate, the decoration comprising a lower surface arranged on a side of the base plate and an upper surface opposite the lower surface, wherein the decoration is mounted on the base plate by an assembly of elements comprising:

a fixing screw screwed into a threaded hole arranged in the base plate, a support bar comprising a proximal end secured to the base plate by the fixing screw and a distal end attached to a first point of the lower surface of the decoration, a projection of the first point in a plane of the base plate being away from the fixing screw, a support foot having a proximal end held in a fixed position in the plane of the base plate and a distal end attached at a second point of the lower surface of the decoration, a projection of the second point in the plane of the base plate being away from the fixing screw and from the projection of the first point, and a spacer which forms a lateral connection between the fixing screw and the support foot, the spacer being secured with the support bar to the base plate by the fixing screw.

2. The dial according to claim 1, wherein the positions of the fixing screw and of the projections of the first and second points form a triangle in the plane of the base plate.

3. The dial according to claim 1, wherein the support foot comprises an arbor whose distal end is attached to the lower surface of the decoration, and wherein the spacer is provided with a through hole for the passage of the arbor.

4. The dial according to claim 3, wherein the proximal end of the arbor is formed of a portion of increased cross-section which is embedded in a cavity made in the base plate, in order to hold the portion of increased cross-section in a fixed position in the plane of the base plate.

5. The dial according to claim 4, wherein the spacer holds the portion of increased cross-section inside the cavity.

6. The dial according to claim 4, wherein the assembly further comprises a part made from a shock absorber material between the portion of increased cross-section and the bottom of the cavity.

7. The dial according to claim 3, wherein the arbor is essentially perpendicular with respect to the plane of the base plate.

8. The dial according to claim 7, wherein the arbor is a supplementary screw, whose portion of increased cross-section foil is a screw head, and wherein the second point of the lower surface of the decoration is provided with a threaded hole into which the distal end of the supplementary screw is screwed.

9. The dial according to claim 8, wherein the support foot further comprises a tube which surrounds one portion of the supplementary screw and wherein the tube is gripped between the spacer and the lower surface of the decoration by the force exerted by the engagement of the supplementary screw in the threaded hole provided in the lower surface of the decoration.

10. The dial according to claim 1, wherein the support bar comprises an am inclined with respect to the plane of the base plate.

11. The dial according to claim 1, wherein the proximal end of the support bar comprises a first plate embedded in a first cavity made in the base plate, the threaded hole arranged in the base plate being at the bottom of said first cavity wherein the first plate is embedded.

12. The dial according to claim 1, wherein the distal end of the support bar comprises a second plate embedded in a second cavity made in the lower surface of the decoration.

13. The dial according to claim 1, wherein the distal end of the support bar is attached to the lower surface of the decoration by welding or adhesive bonding.

14. A timepiece comprising:

a dial for a timepiece, the dial comprising a base plate provided with at least one three-dimensional decoration offset away from the base plate, the decoration comprising a lower surface arranged on a side of the base plate and an upper surface opposite the lower surface, wherein the decoration is mounted on the base plate by an assembly of elements comprising:

a fixing screw screwed into a threaded hole arranged in the base plate, a support bar comprising a proximal end secured to the base plate by the fixing screw and a distal end attached to a first point of the lower surface of the decoration, a projection of the first point in a plane of the base plate being away from the fixing screw, and a support foot having a proximal end held in a fixed position in the plane of the base plate and a distal end attached at a second point of the lower surface of the decoration, a projection of the second point in the plane of the base plate being away from the fixing screw and from the projection of the first point, and a spacer which forms a lateral connection between the fixing screw and the support foot, the spacer being secured with the support bar to the base plate by the fixing screw.

15. The timepiece according to claim 14, wherein the timepiece is a watch.

* * * * *